US005261668A

United States Patent [19]

Hausammann

[11] Patent Number: 5,261,668

[45] Date of Patent: Nov. 16, 1993

[54] LOGIC GAME

[76] Inventor: Christoph Hausammann, 325, Route de Lac, CH-1787 Motier, Switzerland

[21] Appl. No.: 926,207

[22] Filed: Aug. 6, 1992

[51] Int. Cl.[5] ..... A63F 9/08

[52] U.S. Cl. ..... 273/153 S; 273/281

[58] Field of Search ..... 273/153 R, 153 S, 281

[56] References Cited

U.S. PATENT DOCUMENTS

| | | | |
|---|---|---|---|
| 1,349,456 | 8/1920 | Hlasko | 273/153 S |
| 3,148,884 | 9/1964 | Steinhardt | 273/153 S |
| 3,706,457 | 12/1972 | Gonzales et al. | 273/153 S |
| 4,434,982 | 3/1984 | Bearint | 273/153 S |
| 4,470,601 | 9/1984 | Finn | 273/153 S |
| 4,877,248 | 10/1989 | Farraj | 273/153 S |

FOREIGN PATENT DOCUMENTS

| | | | |
|---|---|---|---|
| 2338117 | 2/1975 | Fed. Rep. of Germany | 273/153 S |
| 1299597 | 3/1987 | U.S.S.R. | 273/153 S |
| 2202753 | 10/1988 | United Kingdom | 273/281 |

*Primary Examiner*—V. Millin
*Assistant Examiner*—Steven B. Wong
*Attorney, Agent, or Firm*—Speckman, Pauley & Fejer

[57] ABSTRACT

A logic game having a plurality of courses connected to each other by a common connecting course in which game pieces are inserted. In particular, the game comprises three courses of equal length having guide grooves with varying widths decreasing towards the ends of said courses distal from the common connecting course. The game pieces each have a guide tang of a different size which engages the guide grooves. A prize is displaceably disposed at the distal end of one of said courses. A distal end of another of said courses forms an opening through which said prize can be removed by logical shunting of the game pieces in the courses.

10 Claims, 3 Drawing Sheets

LOGIC GAME

BACKGROUND OF THE INVENTION

1. Field of the Invention

This invention relates to a logic game having a plurality of courses which are connected to each other by a common connecting course in which game pieces are displaceably inserted.

2. Description of the Prior Art

Games of this type are known. Their object mostly is to move the game pieces in a defined sequence from one course into the other. These games are usually very simple.

SUMMARY OF THE INVENTION

It is an object of this invention to provide such a game, where certain obstacles make playing more difficult and in which a correct solution releases a prize, for example a piece of money.

This object is attained in a game in accordance with this invention comprising a plurality of courses which are connected to each other by a common connecting course with game pieces displaceably inserted therein. The plurality of courses are of equal length with guide grooves of different widths, the width of the guide grooves decreasing towards the ends of the courses opposite the ends connected to the common connecting course. The game pieces are provided with guide tangs of different sizes, which guide tangs engage the guide grooves. A prize is displaceably disposed at the end of one of said courses and an opening is provided at the end of another course through which the prize can be withdrawn by shunting of the game pieces in the courses.

At the start of the game, one course is fully occupied by game pieces and one of the game pieces has a guide tang of such a size that it can only be moved in the connecting course and not in any of the other courses.

Play can be made more difficult in accordance with one embodiment of this invention where all the game pieces are of the same size and are differentiated only by guide tangs of different sizes, where the prize is also the same size as the game pieces, but does not have a guide tang.

In accordance with one embodiment of this invention, playing can be made easier where the game pieces can be distinguished from one another by numbers, letters, colors or other markings.

BRIEF DESCRIPTION OF THE DRAWINGS

An exemplary embodiment of the game of this invention is illustrated in the attached drawings, wherein.

DESCRIPTION OF PREFERRED EMBODIMENTS

The game in accordance with one embodiment of this invention comprises a base plate 1 having three courses 2 extending in the long direction of the plate which are connected by a common connecting course 3. The courses 2 and the connecting course 3 are of the same width B and have the same depth. They are provided with recessed guide grooves. Starting at the connecting course 3, the guide grooves in the courses 2 are gradually stepped, from a width b4 to a width b1, while the guide groove in the connecting course has a width b5, which is greater than the width b4.

The game pieces S1 to S5 are in the shape of round disks of equal diameter, so that they can be moved in the courses 2 and 3. The game pieces only differ by the guide tangs of different diameters d1 to d5, which correspond to the width of the guide grooves b1 to b5.

Figure 1:
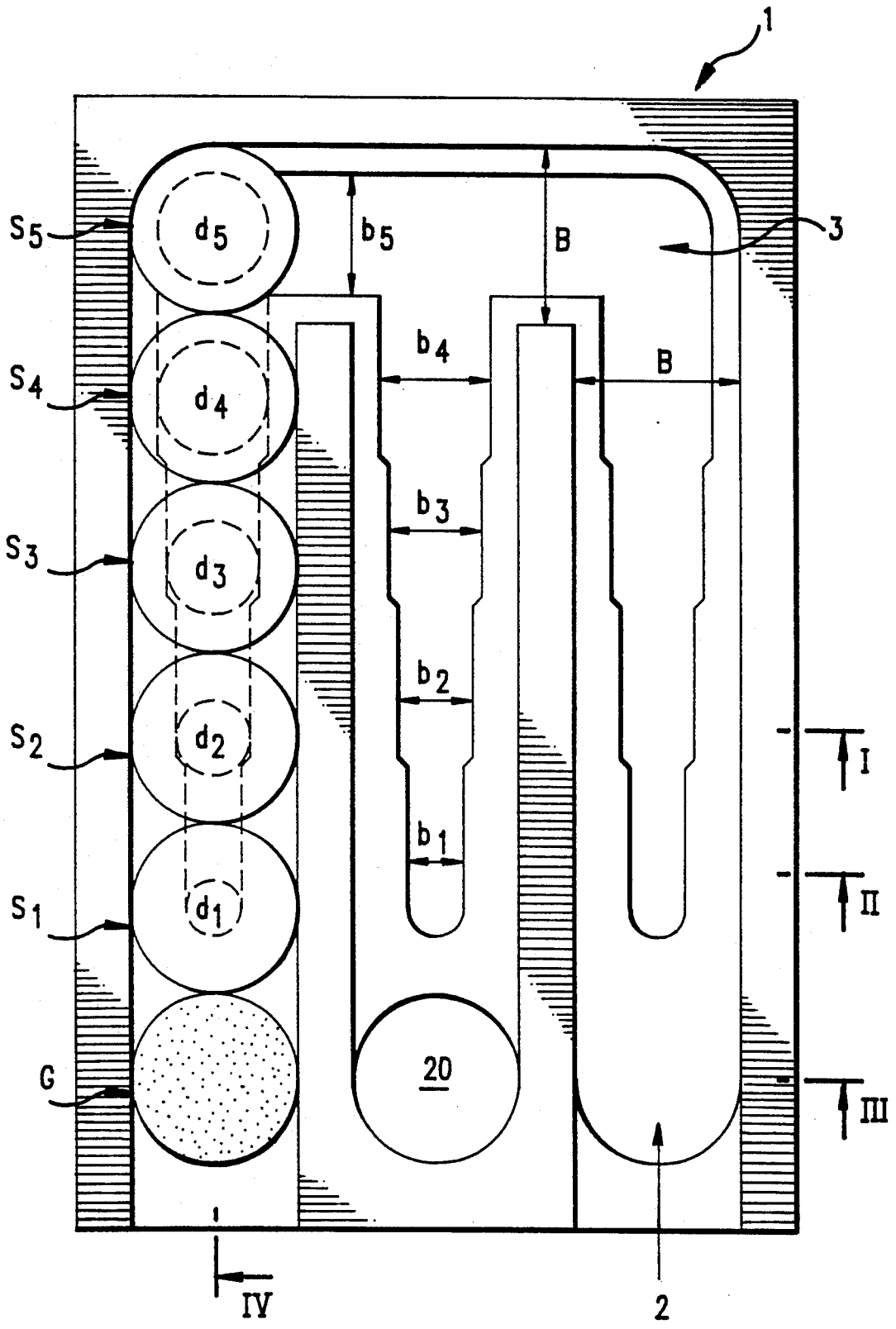
FIG. 1 is a top view of the game, but without a transparent cover plate.

In FIG. 1 of the drawings, a prize, for example a coin, having the same diameter as the game pieces, lies at the bottom of the left course. The center course 2 has an opening 20 at its end.

Figure 3:
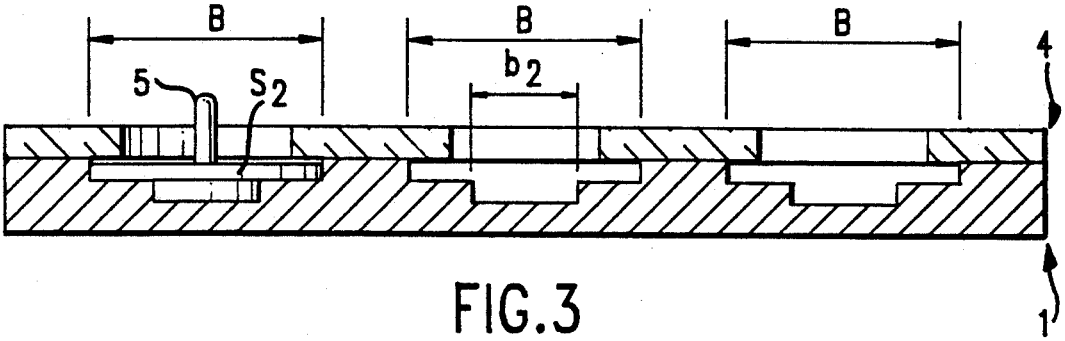
FIG. 3 is a cross-sectional view of the game along the line I of FIG. 1.
Figure 4:
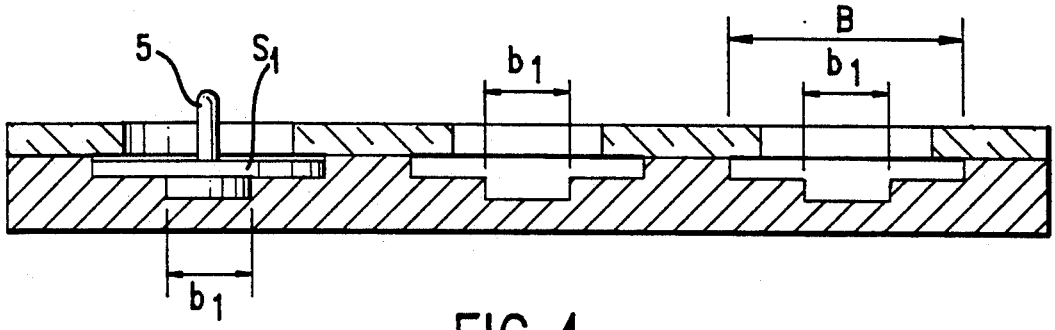
FIG. 4 is a cross-sectional view of the game along the line II of FIG. 1.
Figure 5:
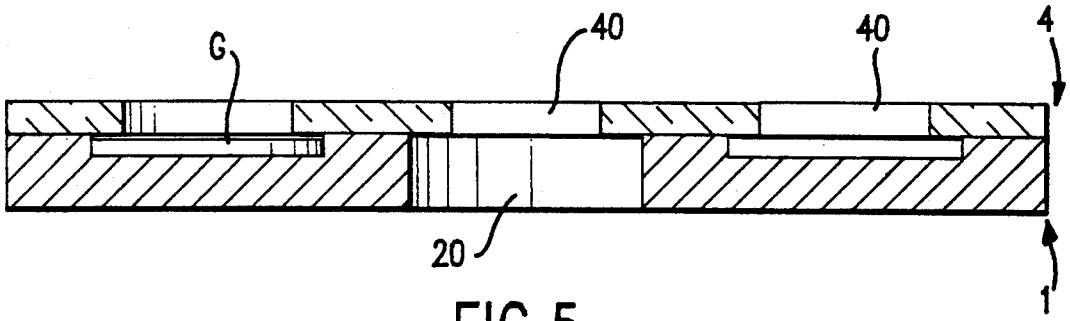
FIG. 5 is a cross-sectional view of the game along the line III of FIG. 1.

FIGS. 3 to 5 are sections along the lines I to III of FIG. 1. It can be clearly seen from these figures, that the courses have the same width B and the same depth, while the guide grooves have a graduated width b1 or b2 and are cut deeper into the base plate 1. FIG. 5 shows a section along the line III of FIG. 1 in which it can be seen that the ends of the two outer courses 2 distal from the connecting course do not have guide grooves, and that the end of the center course distal from the connecting course has an opening 20.

Figure 6:
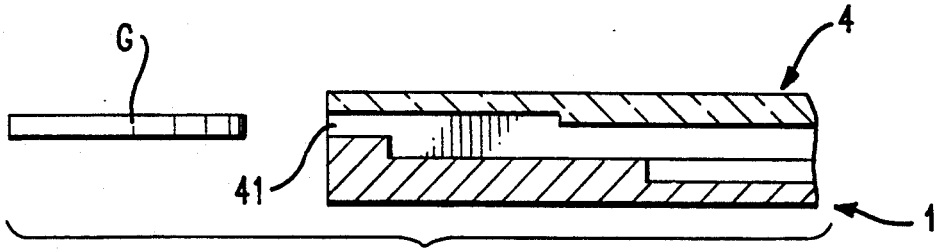
FIG. 6 is a partial cross-sectional view along the line IV of FIG. 1.

FIG. 6 is a section along the line IV of FIG. 1 with the prize G shown at the side of it.

Figure 2:
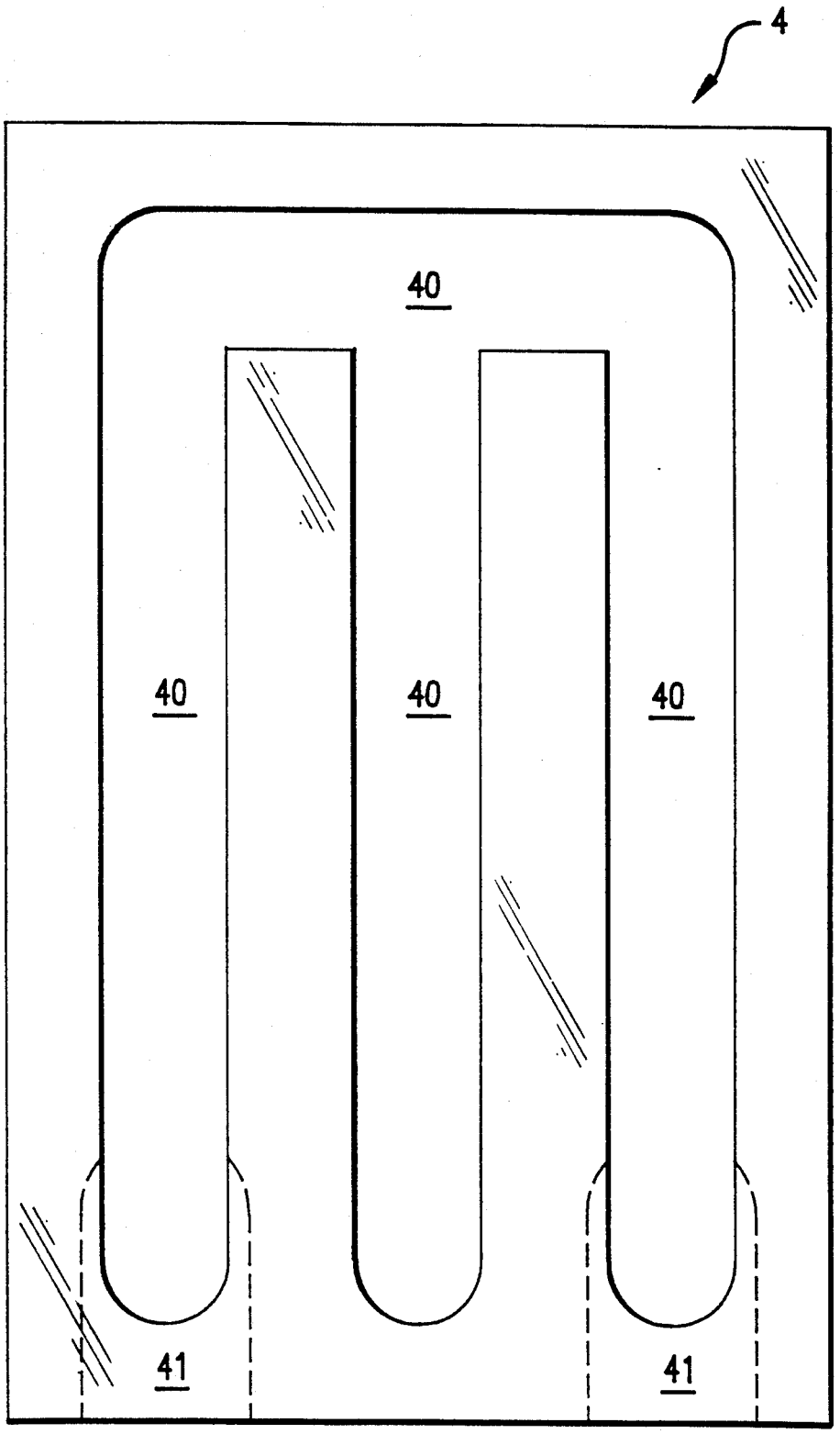
FIG. 2 is a top view of a transparent cover plate for the game shown in FIG. 1.

FIG. 2 illustrates the transparent cover plate 4, which is provided with slits 40. The cover plate 4 is connected to the base plate 1, for example by screws, not shown, and assures that neither the game pieces nor the prize can be removed from the courses.

The cover plate 4 has been omitted in FIG. 1 for the sake of clarity, but is shown in the cross-sectional views shown in FIGS. 3 to 6. In FIGS. 3 and 4, it can be seen that the game pieces are provided with a handle 5 for easier displacement of the game pieces in the courses. From FIG. 6 it can also be seen that the cover plate 4 has been slightly milled at the lower ends at 41 (also see FIG. 2), so that the prize can be inserted into the left or right course slightly pinched.

The game piece S5 is sized so that it can only be pushed back and forth in the connecting course 3, but cannot be inserted into any of the courses 2.

The game piece S4 can only be inserted into the courses 2 up to the portion of the guide grooves having width b4. The game piece S3 can be inserted into the courses 2 at most as far as the portion of the guide groove having width b3, and so on.

The object of the game in the initial position of the game pieces S1 to S5 as shown in FIG. 1 is to bring the game pieces S1 to S5 from the left course 2 into the right course 2 by logical shunting (movement back and forth). This frees the path for the prize to be moved from the left course 2 into the center course 2, at the end of which it comes out through the opening 20. The game piece 5 can only be pushed back and forth in the connecting course 3 and blocks the entrance to one of the courses 2. Each of the game pieces S1 to S4 can only be pushed into a course as far as their guide tangs permit.

It should be obvious that with an appropriate layout of the base plate, the courses and the guide grooves it is also possible to provide a game with less or more game pieces.

I claim:

1. In a logic game having a plurality of courses which are connected to each other by a common connecting course, in which game pieces have been displaceably inserted, the improvement comprising: the game having three courses (2) of equal length, each of said courses (2) having a guide groove (b1 to b4), the width of each of said guide grooves decreasing towards the ends of said courses distal from said common connecting course, a plurality of game pieces, each of said game pieces having a guide tang (d1 to d4), the size of each said guide tang being different, said guide tangs engaging the guide grooves, one of said game pieces (S5) having said guide tang (d5) sized to be displaceable only in said connecting course (3), a prize (G) having no guide tang said distal end of at least one of said courses forming a slit (41) through which said prize (G) is insertable into said course and said distal end of another of said courses forming an opening (20) from which the prize can be taken by logical shunting of the game pieces in the courses.

2. In a game in accordance with claim 1, wherein at a start of the game, one of said courses is filled with said game pieces.

3. In a game in accordance with claim 2 wherein the size of said remaining portion of each of said game pieces is equivalent, and the prize (G) has the same size as said remaining portion of each of said game pieces.

4. In a game in accordance with claim 3 wherein the courses are covered by a plate (4) which prevents removal of the game pieces or of the prize, said plate having a plurality of slits (42) adapted to allow a displacement of the game pieces (S1 to S5) and the prize (G).

5. In a game in accordance with claim 4, wherein each of said game pieces comprises a handle (5) extending through the slit (40) in the plate (4).

6. In a game in accordance with claim 3, wherein said game pieces are distinguishable from one another by number, letters, colors or other markings.

7. In a game in accordance with claim 1 wherein the size of said remaining portions of each of said game pieces is equivalent, and the prize (G) has the same size as said remaining portion of each of said game pieces.

8. In a game in accordance with claim 7, wherein said game pieces are distinguishable from one another by number, letters, colors or other markings.

9. In a game in accordance with claim 1 wherein the courses are covered by a plate (4) which prevents removal of the game pieces or of the prize, said plate having a plurality of slits (42) adapted to allow a displacement of the game pieces (S1 to S5) and the prize (G).

10. In a game in accordance with claim 4, wherein each of said game pieces comprise a handle (5) extending through the slit (40) in the plate (4).

* * * * *